United States Patent [19]

Schmolke

[11] 4,339,851

[45] * Jul. 20, 1982

[54] BEATER ROLL FOR OPEN-END SPINNING MACHINES

[75] Inventor: Karl-Heinz Schmolke, Neuweiler, Fed. Rep. of Germany

[73] Assignee: Hollingsworth GmbH, Neubulach, Fed. Rep. of Germany

[ * ] Notice: The portion of the term of this patent subsequent to Jan. 4, 1997, has been disclaimed.

[21] Appl. No.: 84,789

[22] Filed: Oct. 15, 1979

[51] Int. Cl.[3] ..... D01G 15/14

[52] U.S. Cl. ..... 19/97; 19/112

[58] Field of Search ..... 19/97, 112; 57/58.93, 57/58.95

[56] References Cited

U.S. PATENT DOCUMENTS

| | | | |
|---|---|---|---|
| 1,346,637 | 7/1920 | Coulston | 19/97 |
| 1,530,285 | 3/1925 | Allen | 19/97 |
| 2,340,221 | 1/1944 | Hollingsworth | 19/112 |
| 2,842,802 | 7/1958 | Hollingsworth | 19/112 |
| 2,851,736 | 9/1958 | Hollingsworth | 19/112 |
| 3,654,667 | 4/1972 | Ling | 19/97 |
| 3,968,542 | 7/1976 | Hollingsworth | 19/97 |
| 4,044,427 | 8/1977 | Ankrom et al. | 19/112 |
| 4,208,767 | 6/1980 | Schmolke | 19/97 |

FOREIGN PATENT DOCUMENTS

| | | |
|---|---|---|
| 2364544 | 7/1975 | Fed. Rep. of Germany . |

*Primary Examiner*—Louis Rimrodt
*Attorney, Agent, or Firm*—Max Fogiel

[57] ABSTRACT

An opening or beater roller for open-end spinning machines, in which a cylindrical roller has a sawtooth wire wound helically onto its outer surface. The arrangement is such that a base region is widened in relation to the teeth. Base regions of adjacent turns of sawtooth wire are separated by a gap from one another, and the ratio of the height to the width of the base region is less than one.

7 Claims, 4 Drawing Figures

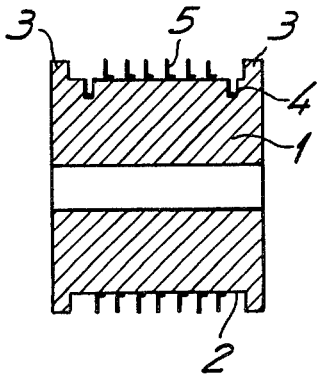
Fig.1
Fig.2
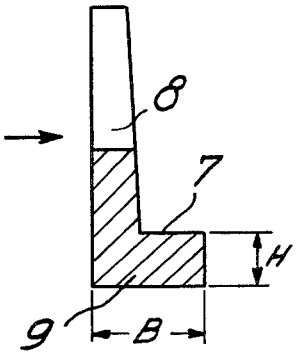
Fig.3
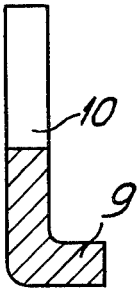
Fig.4
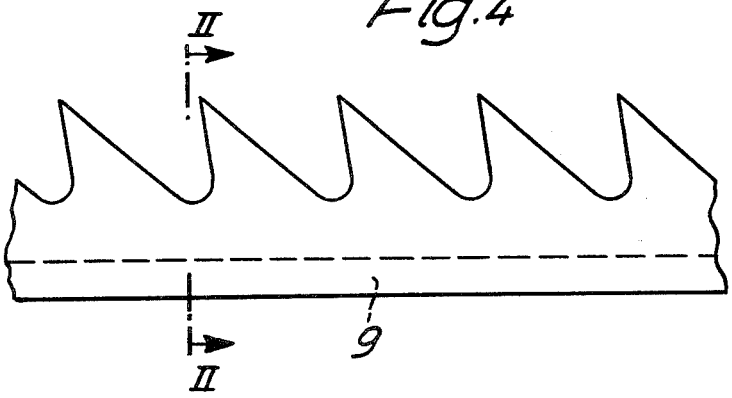

BEATER ROLL FOR OPEN-END SPINNING MACHINES

BACKGROUND OF THE INVENTION

This invention relates to an opening roller for open-end spinning machines comprising a cylindrical roller body and a sawtooth wire wound helically onto the outer surface thereof which has a base region widened in relation to the teeth and which is wound under tension onto the outer surface and fixed at its ends to the roller body, the base regions of adjacent turns of the sawtooth wire being separated by a gap from one another.

One known opening roller of this type (German Auslegeschrift No. 2,364,544) uses standard commercial sawtooth wires of the kind used for example in cards for carding fibrous material. Standardised sawtooth wires such as these are obtainable with base regions between 1.3 and 1.5 mm in height.

It has been found that opening rollers such as these give a yarn of poorer quality, i.e. a yarn characterised by irregularities in the form of thick and thin zones, in relation to opening rollers of the type in which the base region of the sawtooth wire is embedded in a helical groove. An investigation into the cause of these irregularities has shown that the parallel position of the fibres separated by the opening roller is inadequate.

SUMMARY OF THE INVENTION

The object of the present invention is to provide an opening roller of the type mentioned at the beginning which avoids the occurrence of yarn irregularities.

It has surprisingly been found that this object may be achieved by using a sawtooth wire in which the ratio of the height to the width of the base region is less than 1.

The ratio of the height to the width of the base region should preferably be from 0.4 to 0.6. In this connection, it is of advantage for the height of the base region to be less than 0.5 mm.

Alternatively, the height of the base region may be equal to the maximum thickness of the tooth region, i.e. equal to the thickness of the tooth region where it adjoins the base region.

BRIEF DESCRIPTION OF THE DRAWINGS

Several examples of embodiment of the invention are described in detail in the following with reference to the accompanying drawings, wherein:

FIG. 1 is an axial longitudinal section through an opening roller.

FIG. 2 is a section through a sawtooth wire on the line II—II of FIG. 4.

FIG. 3 is a sectional view corresponding to FIG. 2 of another embodiment of a sawtooth wire.

FIG. 4 is a plan view of part of a sawtooth wire in the direction of the arrow in FIG. 2.

DESCRIPTION OF THE PREFERRED EMBODIMENTS

The opening roller shown in FIG. 1 comprises a roller body 1 with a cylindrical, smooth outer surface 2 which is delimited at its ends by peripheral shoulders 3. In the vicinity of each peripheral shoulder, a groove 4 is milled or sawn into the outer surface, extending over only a small part of the periphery. A sawtooth wire 5 is wound in helical turns onto the outer surface 2, the beginning of the sawtooth wire being anchored in one groove 4 and its end in the other groove 6 so that the sawtooth wire lies under tension on the roller body.

The cross-sectional profile of the sawtooth wire illustrated in FIG. 2 (on the line II—II of FIG. 4) shows that the base region 7 has a width B which is approximately twice the height H. The tooth region 8 is of standard design and construction.

FIG. 3 shows the cross-sectional profile of another sawtooth wire in which the base region 9 has a height corresponding to the thickness of the tooth region 10. A profile such as this may be obtained by canting the base region through 90° starting from a wire of rectangular profile. In this case, the ratio of the height to the width of the base region 9 may readily be freely selected.

FIG. 4 is a side elevation of the sawtooth wire, the boundary between the tooth region 10 and the base region 9 being shown in chain lines.

Sawtooth wires with such a low ratio of the height to the width of the base region are not commercially available. However, sawtooth wires of this type used as a covering for opening rollers where the base region is not embedded in grooves of the roller body enable a considerably better yarn quality to be obtained than standard commercially available sawtooth wires.

I claim:

1. An opening or beater roll for open-end spinning machines comprising a cylindrical roller body and a sawtooth wire wound helically onto the outer surface thereof which has a base region widened in relation to the teeth and which is wound under tension onto the outer surface and fixed at its ends to the roller body, base regions of adjacent turns of the sawtooth wire being separated by a gap from one another, the ratio of the height to the width of the base regions being $\leqq 1$; said sawtooth wire being wound on a portion of the outer surface of the cylindrical roller body; said portion being free of grooves so that said wire lies directly on the outer grooveless surface of said cylindrical roller body.

2. An opening roller as claimed in claim 1, wherein the ratio of the height to the width of the base region is between 0.4 and 0.6.

3. An opening roller as claimed in claim 2 wherein the height of the base region is less than 0.5 mm.

4. An opening roller as claimed in claim 2 wherein the height of the base region is equal to the maximum thickness of the tooth region.

5. An opening roller as claimed in claim 1 wherein the height of the base region is less than 0.5 mm.

6. An opening roller as claimed in claim 1 wherein the height of the base region is equal to the maximum thickness of the tooth region.

7. An opening or beater roll as defined in claim 1, wherein said base region is formed by canting the base region through 90° from a wire of rectangular profile.

* * * * *